US007431159B2

(12) United States Patent
Lawrence et al.

(10) Patent No.: US 7,431,159 B2
(45) Date of Patent: Oct. 7, 2008

(54) BOX-WITHIN-BOX REINFORCED SHIPPING CARTON

(75) Inventors: Andrew Mark Lawrence, Chatsworth, CA (US); Anthony Mangia, North Hollywood, CA (US)

(73) Assignee: Bobrick Washroom Equipment, Inc., North Hollywood, CA (US)

( * ) Notice: Subject to any disclaimer, the term of this patent is extended or adjusted under 35 U.S.C. 154(b) by 96 days.

(21) Appl. No.: 10/919,658

(22) Filed: Aug. 16, 2004

(65) Prior Publication Data

US 2006/0032778 A1 Feb. 16, 2006

(51) Int. Cl.
*B65D 85/30* (2006.01)

(52) U.S. Cl. ..... 206/454; 206/521; 229/112

(58) Field of Classification Search ..... 206/444, 206/461, 420, 421, 446, 449, 451, 454, 455, 206/456, 521, 591, 586; 229/115, 108, 112, 229/116, 108.1, 111, 113, 114
See application file for complete search history.

(56) References Cited

U.S. PATENT DOCUMENTS 1,314,869 A * 9/1919 Gray ..... 206/449
1,669,139 A * 5/1928 Martin ..... 229/125.37
1,764,251 A 6/1930 Farago
2,022,721 A * 12/1935 Hompe ..... 206/45.29
2,132,632 A 10/1938 Kondolf
2,746,667 A * 5/1956 Murphy ..... 206/454
3,222,190 A * 12/1965 Davis ..... 426/120
3,249,033 A * 5/1966 Cobb, Jr. et al. ..... 430/496
3,286,905 A * 11/1966 Farukhi ..... 229/122
3,412,924 A * 11/1968 Krzyzanowski ..... 229/120.11
3,476,236 A * 11/1969 Skowronski ..... 206/229
3,602,367 A 8/1971 Nathan et al.
3,618,755 A 11/1971 Kean, Sr. et al.
3,682,370 A * 8/1972 Rous ..... 206/521
3,730,418 A 5/1973 Spencer
3,853,219 A * 12/1974 Castine, Jr. ..... 206/448
3,895,754 A * 7/1975 Rosenburg, Jr. ..... 206/521
3,939,978 A * 2/1976 Thomaswick ..... 206/454
4,245,771 A * 1/1981 Christian ..... 229/112
4,324,332 A 4/1982 Willis
4,492,333 A * 1/1985 Roberts ..... 229/115
4,763,789 A * 8/1988 Questel et al. ..... 206/454
4,838,423 A * 6/1989 Lerner et al. ..... 206/454
4,892,193 A 1/1990 Thomas
5,014,905 A * 5/1991 Cassidy ..... 229/113
5,040,721 A * 8/1991 Essack ..... 229/112
5,078,272 A * 1/1992 Combs ..... 206/586
5,375,713 A * 12/1994 Horvat et al. ..... 206/418
5,381,903 A * 1/1995 Hardenne ..... 206/526
5,417,341 A * 5/1995 Petriekis et al. ..... 220/592.25
5,437,406 A 8/1995 Gordon et al.
5,542,537 A * 8/1996 Ford ..... 206/431
5,729,960 A * 3/1998 Davis ..... 53/458
5,909,808 A 6/1999 Bartholomew
6,039,243 A * 3/2000 Lickton ..... 229/117.01
6,612,483 B2 9/2003 Harris et al.

* cited by examiner

*Primary Examiner*—Jacob K Ackun, Jr.
(74) *Attorney, Agent, or Firm*—Christie, Parker & Hale, LLP

(57) ABSTRACT

A packaging assembly for protecting a fragile article comprises a fragile article, packaging material around the fragile article, an outer carton containing the packaging material and the fragile article, and at least one cavity within the outer carton. The cavity is outside of the packaging material.

23 Claims, 5 Drawing Sheets

BOX-WITHIN-BOX REINFORCED SHIPPING CARTON

FIELD OF THE INVENTION

The present invention relates to a shipping carton and insert for use in packaging breakable or fragile articles.

BACKGROUND

Flat, fragile products such as framed glass mirrors, are highly subject to breakage during shipping and handling. Protective packaging that is sufficient for normal handling often does not withstand more aggressive handling. While known rectangular shipping cartons have been used to protect products during shipping and handling, experience has shown that the geometry of these packages makes it convenient for handlers to lay them flat at the base of, or within a stack of goods. The crushing which results from this stacking often damages the fragile products within the rectangular shipping carton despite the use of protective packaging, and is responsible for a significant amount of the breakage realized with such goods. Experience has also demonstrated that warning statements on the package such as "do not lay flat" or "this end up" are frequently ignored during shipping and handling.

With the parcel shipment of fragile items such as mirrors and the like, a reduction in breakage reduces the cost of addressing dissatisfied customer complaints, processing replacement orders and stocking and handling replacement items. The reliable delivery of undamaged, unbroken items improves customer satisfaction. Known methods for avoiding breakage include strapping Masonite to a package, this however is expensive and cumbersome.

SUMMARY OF THE INVENTION

The invention described herein is a packaging system and method to protect the shipping and handling of a fragile flat product that is packed in its own container or carton. Unlike most conventional methods of shipping fragile items, the method described herein does not require any additional packing material and/or strapping in order to protect the fragile product boxed in its own container.

A packaging assembly is disclosed for protecting a fragile article which comprises a fragile article, packaging material around the fragile article and an outer carton containing the packaging material and the fragile article. The outer carton in turn comprises a base, a first wall extending up from the base, and a second wall extending up from the base. The base rests on a horizontal plane, at least one of the first wall and second wall forms an acute angle with the horizontal plane, and the sum of the angles formed by the first wall and second wall with the horizontal plane is not equal to one hundred and eighty degrees.

Figure 1:
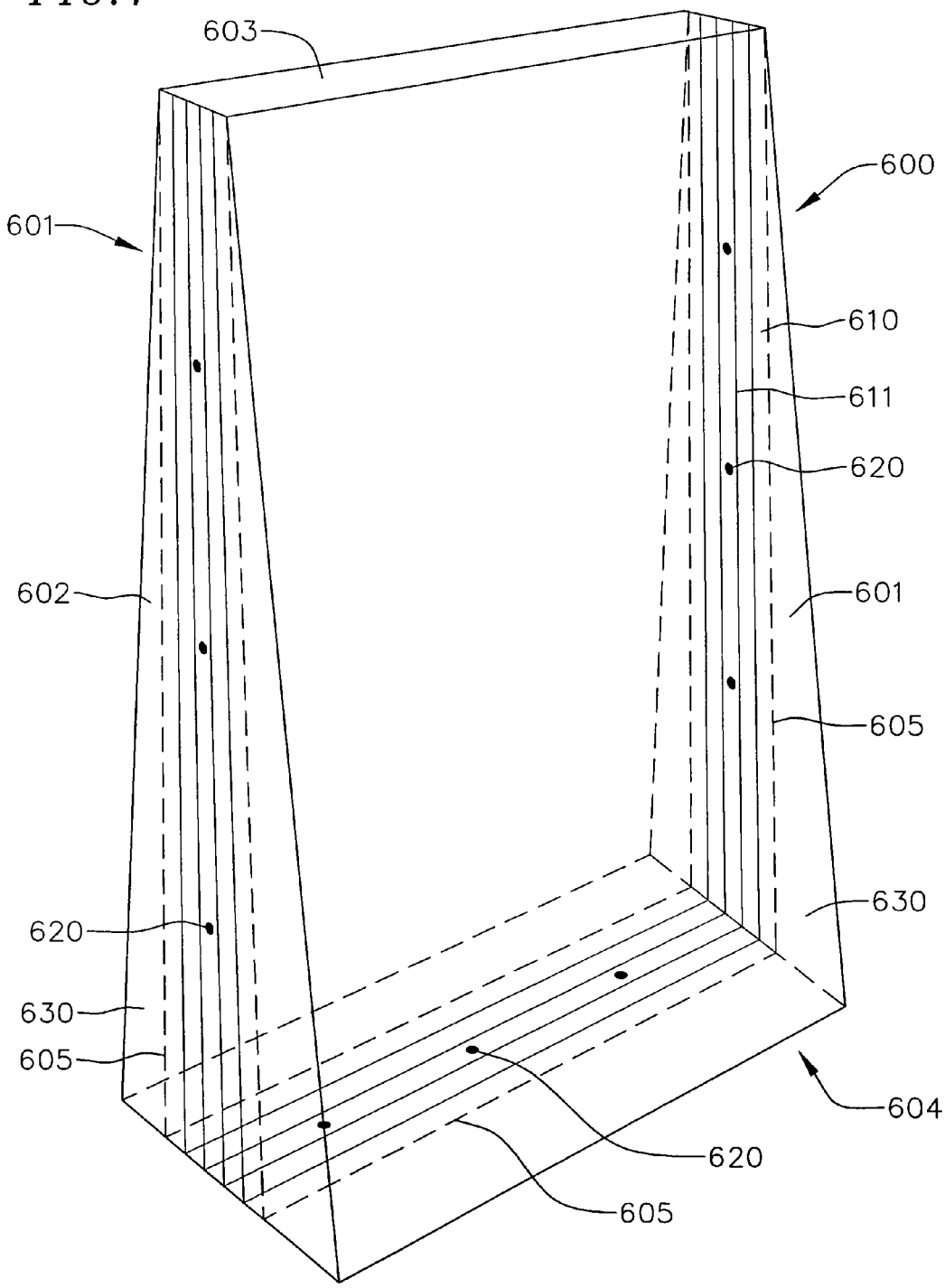
FIG. 1 shows a perspective view of an assembled shipping carton.

Before any embodiment of the invention is explained in detail, it is to be understood that the invention is not limited in its application to the details of construction and arrangements of components set forth in the following description, or illustrated in the drawings. The invention is capable of alternative embodiments and of being practiced or being carried out in various ways. Also, it is to be understood that the terminology used herein is for the purpose of illustrative description and should not be regarded as limiting.

DETAILED DESCRIPTION OF THE INVENTION

Known shipping cartons used for transporting fragile packaged materials such as glass have a relatively flat geometry making it convenient for handlers to lay them flat and stack them with other goods. When these cartons are stacked together with or underneath of other items, deformations are caused in the structure of the shipping carton, putting excess pressure on the packaged materials contained within. These packaged materials, which may be panes of glass, mirrors, or sheets of some other fragile material, are susceptible to breakage when subjected to shear forces across their thinnest dimensions produced by crushing or bending of the shipping carton.

Figure 3:
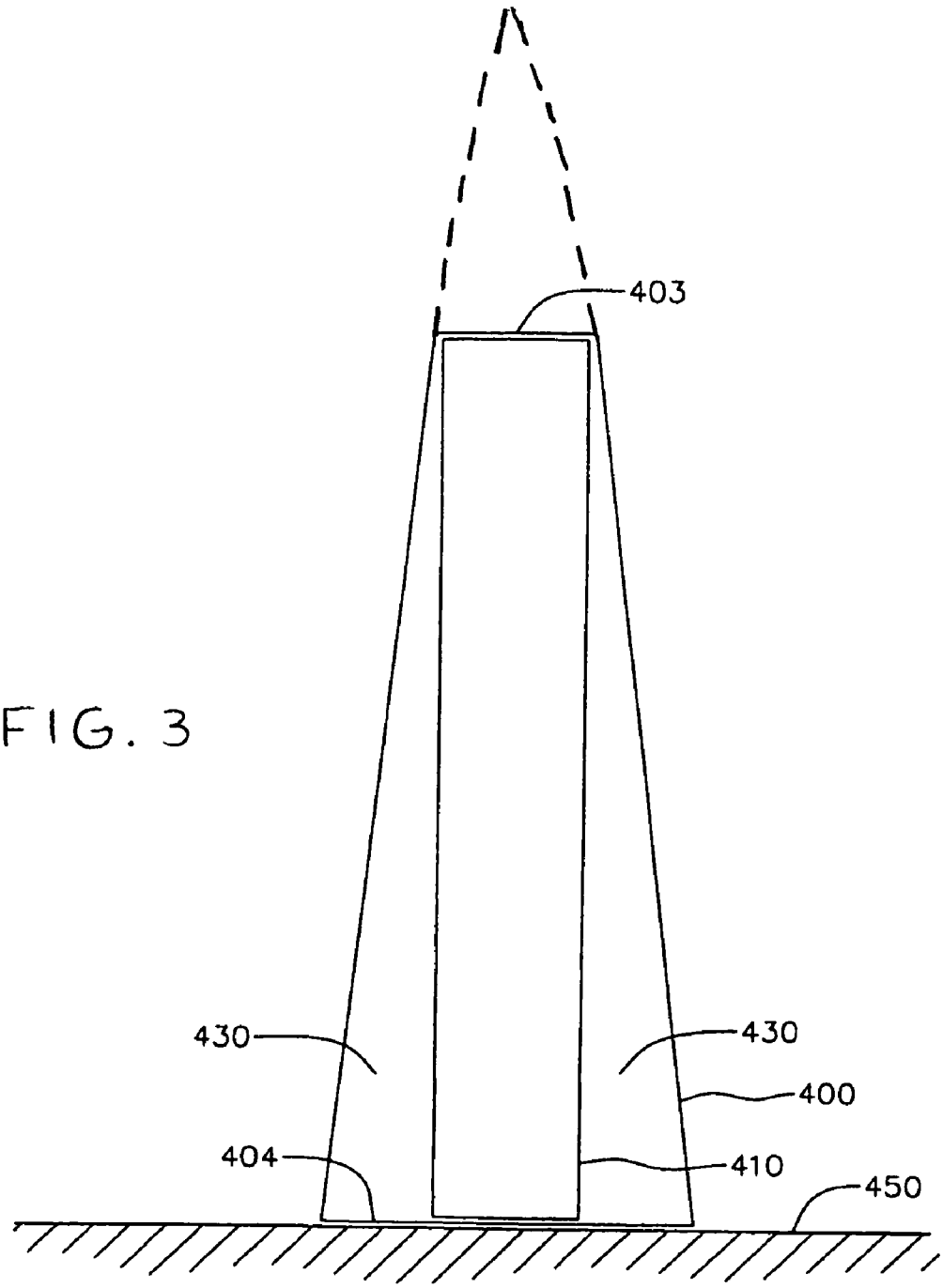
FIG. 3 shows two embodiments of the present invention wherein the shipping carton has an "A" shape, and a triangular shape, respectively, when viewed from the side.

FIGS. 1 and 3 show a perspective view and a side view of a first embodiment of an assembled shipping carton embodying one or more features of the present invention. In FIG. 1, a shipping carton 600 includes a pair of matching main panels 601. One main panel 601 comprises the front, and the other the rear, of the shipping carton 600. In one embodiment the main panels 601 are rectangular in shape. Likewise, the shipping carton 600 has a pair of matching side panels 602, disposed on either side of the shipping carton 600 and connecting the main panels 601. In one embodiment of the present invention, the side panels 602 are trapezoidal in shape. The side panels 602 may or may not be isosceles trapezoids. They may also be triangular in shape as shown with dashed lines in FIG. 3, or any other suitable shape.

In FIG. 3 a shipping carton 400 is shown enclosing an inner carton 410, and wherein the shipping carton 400 has an "A" shape when viewed from the side. The shipping carton 400 is supported on a surface 450 and has a top panel 403 and a bottom panel 404, and at least one cavity 430 within the shipping carton 400 but without the inner carton 410.

In addition, in FIG. 1, a top panel 603 is provided connected to both the main panels 601 and the side panels 602. In one embodiment the top panel 603 is rectangular in shape. In another embodiment of the present invention, the top panel 603 meets the side panels 602 at a perpendicular angle. In a further embodiment, the top panel 603 meets one or both of the main panels 601 at an angle interior to the shipping carton 600 which is an obtuse angle.

Furthermore, the shipping carton 600 is also provided with a bottom panel 604. The bottom panel 604 is also connected to both the main panels 601 and the side panels 602. In one embodiment the bottom panel 604 is rectangular in shape. In another embodiment of the present invention, the bottom panel 604 meets the side panels 602 at a perpendicular angle, and meets one or both of the main panels 601 at an angle interior to the shipping carton 600 which is an acute angle.

In the event that the bottom panel 604 meets only a first main panel 601 at an acute angle $\theta'$, then the angle $\theta''$ the bottom panel 604 makes with a second main panel 601 is not the supplement of the angle $\theta'$. In this manner the main panels 601 are constrained in that they may not lie in parallel planes; in the vicinity of the bottom panel 604 they are a maximum distance apart and in the vicinity of the top panel 603 they are a minimum distance apart. It is also contemplated however, that in an alternative embodiment, the main panels are parallel to each other.

The acute angle θ' or θ" made by the intersection of the bottom panel 604 and at least one of the main panels 601 at the base of the shipping carton 600 provides an increased rigidity and resistance to crushing of the shipping carton 600, and can deflect forces created when the shipping carton 600 strikes or is struck by another surface.

In one embodiment, the shipping carton 600 has an "A" or trapezoidal shape similar to a conventional "A" frame used from transporting glass when viewed from the side. The appearance of the reinforced shipping carton 600 is distinctive; the overall shape of an isosceles trapezoid mimics the "A frame" that is the universal standard in handling glass or other flat, fragile materials. This appearance makes a shipper's products easily identifiable, and makes the fact that the shipper has taken extra effort to protect the product evident to a recipient.

The shape of the shipping carton 600 discourages a handler from laying the shipping carton 600 flat on either of the main panels 601 and stacking other goods on top of the shipping carton 600; a practice that has led in the past to breakage of the packaged materials within the shipping carton. Were a handler to attempt this, the fact that the main panels 601 do not lie in parallel planes has the result that a sloped main panel 601 would be the only surface available for stacking other packages on top of the shipping carton 600. This sloped surface would cause the other stacked goods to slide off of the shipping carton 600, thus discouraging this practice.

Furthermore, the broad bottom panel 604 and lower center of gravity of the shipping carton 600 encourages a handler to store it on the bottom panel 604. This orientation minimizes the footprint of the shipping carton 600 on a horizontal surface and avoids the problems associated with stacking the shipping carton 600 beneath other packages.

Because the shipping carton 600 is smaller at the top when stored on end (i.e. on the bottom panel 604), and because the center of gravity of the shipping carton 600 is below the vertical center of the shipping carton 600, it is easier to manipulate during shipping and handling than are known packages. These same handling advantages are also available to a customer at his warehouse or job site.

The shipping carton 600 may in one embodiment be constructed from corrugated cardboard. It may also be used to enclose an inner carton 610 occupying an area within the shipping carton 600 denoted by the dashed lines 605. This inner carton 610 may furthermore be secured within the shipping carton 600 by a series of fasteners 620 such as staples, or other appropriate fasteners for securing shipping containers known to one skilled in the art. In one embodiment of the present invention, the inner carton 610 is provided to enclose packaged materials 611, which may be panes of glass, mirrors, or sheets of some other fragile material. The inner carton 610 may also be constructed from corrugated cardboard, and need not fill the entire interior of the shipping carton 600; in the event that it does not, one or more cavities 630 are left within the shipping carton 600 and without the inner carton 610.

In one embodiment, the inner carton 610 is a standard rectangular shipping carton. The packaged materials 611 in the inner carton 610 may be selectively combined with the shipping carton 600 only for parcel shipments where the experienced incidence of damage is high. As such, costs associated with these shipments do not have to be borne by products expected to receive less aggressive handling, which may be shipped alone in a standard rectangular shipping carton.

Figure 2:
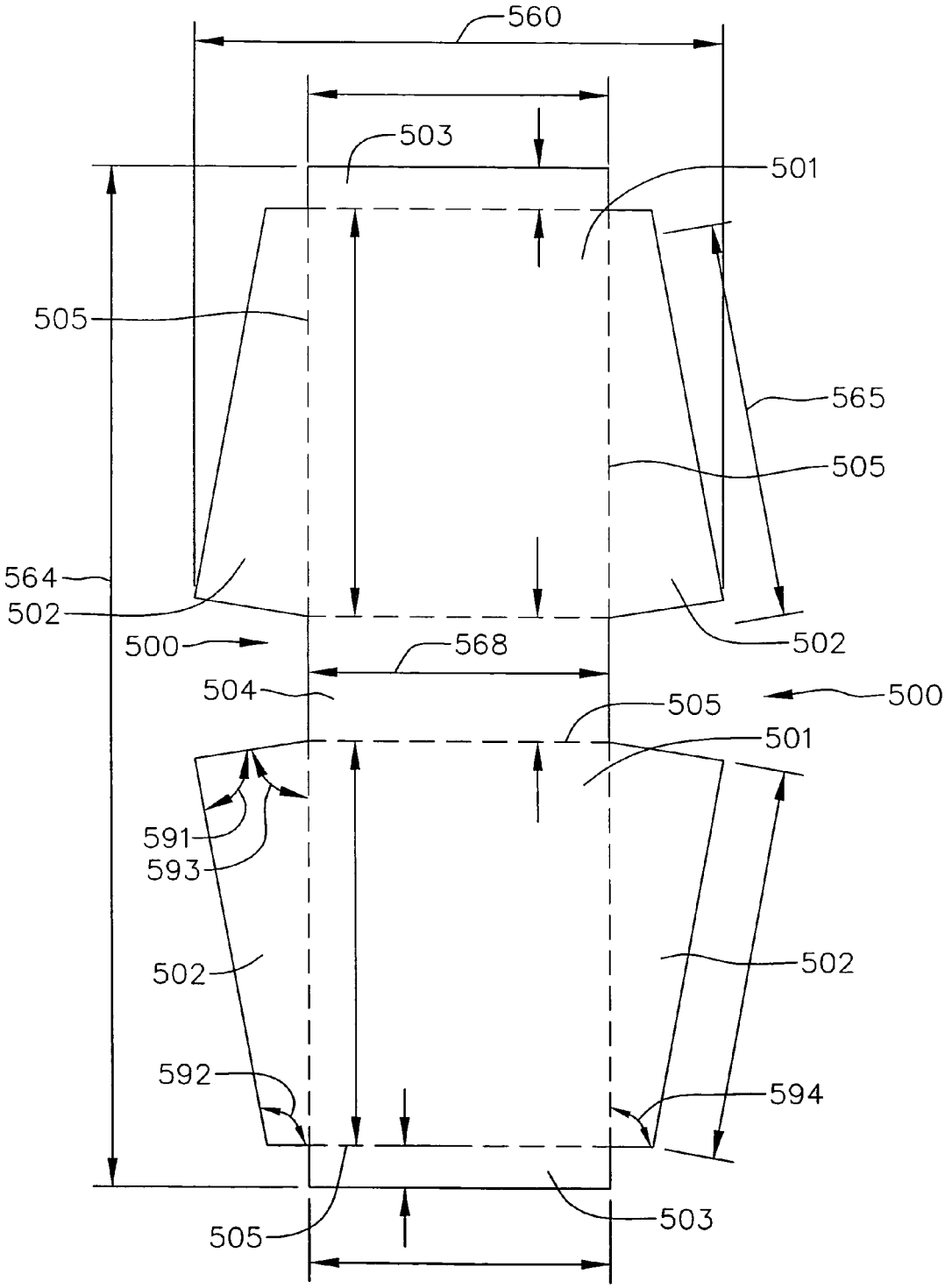
FIG. 2 is a planar view of a complete, unfolded, shipping carton.

FIG. 2 is a planar view of a complete, unfolded shipping carton 500, which may be assembled to become the shipping carton 600 of FIG. 1. As mentioned above, the unfolded shipping carton 500 has a pair of main panels 501, multiple side panels 502, multiple top panels 503, and a bottom panel 504.

In one embodiment the main panels 501 are rectangular in shape. Likewise, the shipping carton 500 has two pair of matching side panels 502, disposed on either side of the main panels 501. In one embodiment of the present invention, the side panels 502 are trapezoidal in shape. The side panels 502 may or may not be isosceles trapezoids, and they may, in a further alternative embodiment, be triangular in shape, as well as being another suitable shape.

In addition, at least one top panel 503 is provided connected to at least one of the main panels 501. In one embodiment the top panel 503 is rectangular in shape. Furthermore, the shipping carton 500 is provided with a bottom panel 504. The bottom panel 504 connects the two main panels 501. In one embodiment the top panel 503 is rectangular in shape.

The side panels 502 are each provided with a series of angles 591 through 594. In an embodiment of the present invention, the angles 591 through 594 measure 85°, 93°, 83° and 99°, respectively. In an alternative embodiment, the angles 591 through 594 measure 83°, 96°, 85° and 94°, respectively. These measurements are understood to be purely exemplary, and could vary by ±4 degrees, or in some cases more.

The panels of the shipping carton 500 are designed to fold along the fold lines 505 so that the flat, unfolded shipping carton 500 may be assembled into the shipping carton 600 of FIG. 1. Accordingly, the main panels 501 may be brought towards each other, allowing top panels 503, as well as two pair of side panels 502, to fold and overlap each other.

These overlapping panels may be secured to each other by fasteners 620 (see FIG. 1) such as staples, tape, adhesive, or any other appropriate method known to one skilled in the art. In one embodiment, the use of non-asphaltic tape in addition to staples to secure the overlapping panels will better secure the panels. In another embodiment, the shipping carton 500 is constructed at the time of use; it is normally stored unused in its flat state, resulting in savings of storage space.

In alternative embodiments of the present invention, the specific number of top panels 503 and side panels 502 may be altered. For example, a single top panel 503 and a single pair of side panels 502 (disposed to either side of only one of the main panels 501) could be used. These embodiments, while simpler, lack the added rigidity of the overlapping panels discussed in the previous embodiment.

The dimensions of the various panels of the shipping carton 500 are denoted by the dimensions 560, 564, 565 and 568. In one embodiment, the dimension 560 is 38.68 inches, the dimension 564 is 70.85 inches, the dimension 565 is 27.91 inches and the dimension 568 is 21.04 inches.

Figure 4:
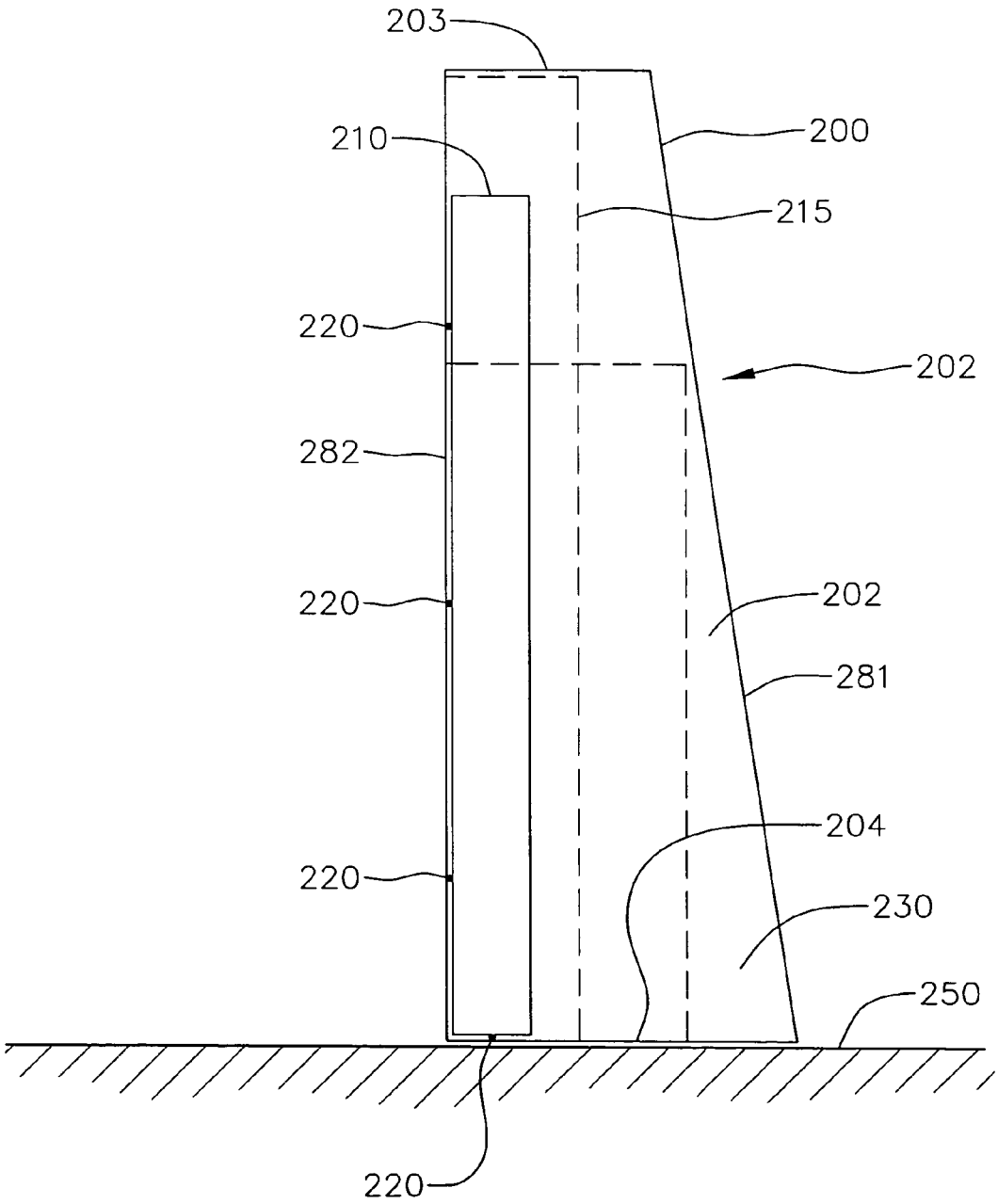
FIG. 4 shows a side view of an alternative embodiment of the present invention.

FIG. 4 shows an embodiment of the present invention having only 1 angled main panel instead of the two angled main panels (with respect to the bottom panel) of FIG. 1. A shipping carton 200 is employed with an inner carton 210 and has a top panel 203 and a bottom panel 204. These panels run in planes parallel to one another. The shipping carton also has a pair of main panels 281 and 282 running in nonparallel planes between the top panel 203 and bottom panel 204. In an alternative embodiment, the two main panels 281 and 282 may be of different lengths from one another. Thus, the top panel 203 and bottom panel 204 together with the main panels 281 and 282 form a non-rectangular convex quadrilateral, or trapezoid.

In a further embodiment, to prevent the inner carton 210 and the products contained within from being loose and unstable within the shipping carton 200, one or more fasteners 220 are inserted through a plurality of sides (e.g. such as one of the main panels 281 and 282) of the shipping carton 200 to the inner carton 210, making the combination one integral package. The fasteners 220 fortify the protection around products contained within the inner carton 210 by fastening two cartons together; in essence a double-walled carton is provided. In another embodiment, fasteners 220 are inserted through the bottom panel 204 as well as two side panels 202 lying in the plane of the page and connecting the main panels 281 and 282, securing the shipping carton 200 to the inner carton 210 on three sides.

The dimensions of the inner carton 210 may be varied to match the alternate sizes 215 of an alternative inner carton. These alternate sizes 215 are merely exemplary; the inner carton 210 may be of any dimensions which fit within the shipping carton 200. The inner carton 210 may or may not contact the interior of the shipping carton 200 on more than one of its panels.

In one embodiment of the shipping carton 200, a recipient opens the top of both the shipping carton 200 and the inner carton 210 for safe and convenient removal of a product contained within. In a further embodiment, the top panel 203, as well as the top surface of the inner carton 210 comprise overlapping flaps that may be unfolded to allow a recipient of the shipping carton 200 access to the products contained within.

Because the main panels 281 and 282 of the shipping carton 200 are not parallel to one another, and because in one embodiment the inner carton 210 comprises an ordinary rectangular solid, a cavity 230 remains within the shipping carton 200 regardless of the size and orientation of the inner carton 210; i.e. the inner carton 210 does not take up all the interior space within the shipping carton 200.

The cavity 230 creates an acute angle on the shipping carton 200 resulting in an increased rigidity and resistance to crushing of the shipping carton 200. This angle can deflect a force otherwise applied to a product contained within the shipping carton 200 when the carton strikes the surface 250, or another surface.

Figure 5:
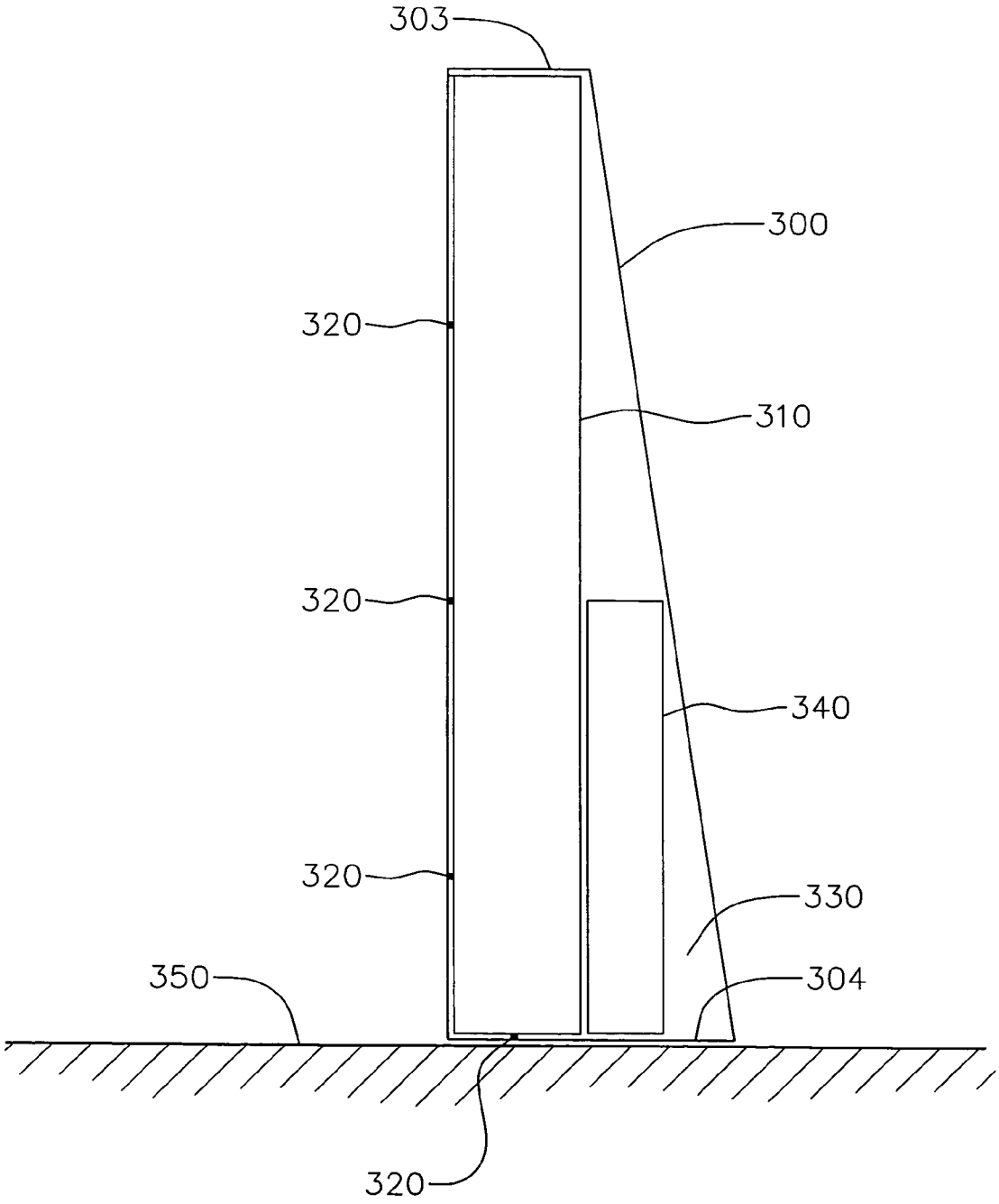
FIG. 5 shows a further alternative embodiment wherein a shipping carton contains an inner carton and inserts provided to stabilize the inner carton within the shipping carton.

FIG. 5 shows another alternative embodiment wherein a shipping carton 300 contains an inner carton 310. As in FIG. 4, at least one cavity 330 is present creating an acute angle in the shipping carton 300, as well as providing the shipping carton 300 with a broad base on the surface 350 and a lower center of gravity. An insert 340 is provided to stabilize the inner carton 310 within the shipping carton 300. In a further embodiment, the inner carton 310 contacts both a top panel 303 and a bottom panel 304. In yet another alternative embodiment, fasteners 320 may be used in addition to the inserts 340 to stabilize the inner carton 310 within the shipping carton 300.

The invention is not limited in the choice of material from which the box can be made. It could be made from corrugated cardboard, or any other appropriate box making material. Furthermore, the shape of the shipping carton is not limited to the "A" or wedge shapes described herein and shown in the drawings. The shipping carton could also be any shape that is substantially non-rectangular so that it makes it difficult to stack, unlike shaped cartons on top of each other while shipping and handling a fragile product.

The reduction in breakage afforded by the proposed packaging system and method not only results in cost savings for replacement goods and handling of replacement orders, but also addresses customer dissatisfaction issues that arise whenever a product experiences a high rate of breakage. Parcel carriers usually do not insure glass goods against such damage.

What is claimed is:

1. A packaging assembly for protecting a fragile article comprising:

a planar fragile article having a first planar side and a second planar side;

a packaging material around the fragile article;

an outer carton containing the packaging material and the fragile article, the outer carton comprising:

a base;

a first planar wall extending up from the base;

a second planar wall extending up from the base;

a pair of side walls extending up from the base and configured to connect the first planar wall and the second planar wall;

at least one cavity within the outer carton;

wherein the first planar wall and the second planar wall are nonparallel to each other;

wherein the cavity is outside of the packaging material; and wherein the fragile article is oriented relative to the outer carton such that the first planar side faces the first planar wall and the second planar side faces the second planar wall.

2. The assembly of claim 1, wherein the cavity is a triangular solid in shape.

3. The assembly of claim 1, wherein the packaging material completely encloses the fragile article.

4. The assembly of claim 3, wherein the packaging material is a shipping carton for packaging fragile articles.

5. The assembly of claim 4, wherein the packaging material is a rectangular shipping carton for packaging flat, fragile articles.

6. The assembly of claim 1, wherein the packaging material is affixed within the outer carton.

7. The packaging assembly of claim 1, wherein at least one of the first planar wall and second planar wall forms an acute angle with the base.

8. The packaging assembly of claim 1, wherein the first planar wall and the second planar wall are connected to the base at a pair of fold lines, wherein each side wall is connected to a corresponding planar wall at a fold line; and wherein the outer carton is foldable along the fold lines from a collapsible form to form an assembled outer carton.

9. The packaging assembly of claim 1, wherein the side walls are trapezoidal.

10. The packaging assembly of claim 1, wherein the the side walls are triangular.

11. The assembly of claim 1, wherein the packaging material is affixed within the outer carton by at least three sides of the packaging material.

12. The assembly of claim 1, wherein the packaging material is affixed within the outer carton using one or more fasteners.

13. The assembly of claim 1, further comprising at least one insert within the outer carton immobilizing the packaging material within the outer carton.

14. The assembly of claim 1, wherein the outer carton and the packaging material are constructed of corrugated cardboard.

15. A packaging assembly for protecting a fragile article comprising:

a glass sheet;

a rectangular box around the glass sheet;

an outer carton comprising:

a pair of nonparallel and flat main panels, each main panel having four sides;

a bottom panel connecting the pair of flat main panels;

a pair of parallel flat side panels extending from each of the main panels and connecting the pair of flat main panels; and a triangular cavity defined by a space between the rectangular box and any one of the main panels.

16. The assembly of claim 15, wherein the rectangular box completely encloses the fragile articles.

17. The assembly of claim 16, wherein the rectangular box is a shipping carton for packaging fragile articles.

18. The assembly of claim 15, wherein the rectangular box is affixed within the outer carton.

19. A packaging assembly for protecting a fragile article comprising:

a glass sheet;

a rectangular box around the glass sheet;

an outer carton containing the box and the glass sheet, the outer carton comprising:

a base;

a first planar wall forming an angle of less than 90 degrees with the base;

a second planar wall forming an angle of less than 90 degrees with the base; and a pair of side walls extending up from the base and configured to connect the first planar wall and the second planar wall;

wherein the first planar wall and the second planar wall are in one-piece with the base and extend up from the base toward each other such that the first planar wall and the second planar wall are nonparallel to each other;

wherein a surface area of the first planar wall and a surface area of the second planar wall are greater than a surface area of each of the pair of side walls and a surface area of the base; and wherein the box and the outer carton form a triangular cavity within the outer carton and outside the box, a triangle shape of the triangular cavity defined by a flat panel of the box, a portion of the base and a portion of any one of the first planar wall and the second planar wall.

20. A packaging assembly comprising:

a glass sheet;

a rectangular box surrounding the entire glass sheet;

an outer carton containing the box and the glass sheet, the outer carton comprising:

a base;

a first planar wall extending up from the base;

a second planar wall extending up from the base;

a pair of side walls extending up from the base and configured to connect the first planar wall and the second planar wall;

at least one cavity within the outer carton;

wherein the first planar wall and the second planar wall are nonparallel to each other;

wherein the cavity is outside of the box; and wherein planar sides of the glass sheet face the first planar wall and the second planar wall;

wherein a surface area of the first planar wall and a surface area of the second planar wall are greater than a surface area of each of the pair of side walls and a surface area of the base.

21. The packaging assembly of claim 20, wherein the planar glass article comprises a mirror.

22. The assembly of claim 20, wherein the cavity is a triangular solid in shape.

23. The assembly of claim 20, wherein the rectangular box is affixed within the outer carton.

* * * * *